US005222882A

United States Patent [19]

McCullough

[11] Patent Number: 5,222,882

[45] Date of Patent: Jun. 29, 1993

[54] TIP SEAL SUPPORTING STRUCTURE FOR A SCROLL FLUID DEVICE

[75] Inventor: John E. McCullough, Carlisle, Mass.

[73] Assignee: Arthur D. Little, Inc., Cambridge, Mass.

[21] Appl. No.: 837,966

[22] Filed: Feb. 20, 1992

[51] Int. Cl.[5] ..... F01C 1/04; F01C 19/08

[52] U.S. Cl. ..... 418/55.2; 418/55.4; 418/188

[58] Field of Search ..... 418/55.2, 55.4, 142, 418/188; 277/204

[56] References Cited

U.S. PATENT DOCUMENTS

| | | | |
|---|---|---|---|
| 3,994,635 | 11/1976 | McCullough | 418/55.4 |
| 3,994,636 | 11/1976 | McCullough et al. | 418/55.4 |
| 4,415,317 | 11/1983 | Butterworth | 418/55.4 |
| 4,498,852 | 2/1985 | Hiraga | 418/55.4 |
| 4,561,832 | 12/1985 | Shimizu | 418/55.4 |
| 4,753,582 | 6/1988 | Morishita et al. | 418/188 |
| 4,753,583 | 6/1988 | Hiraga et al. | 418/55.4 |
| 4,824,343 | 4/1989 | Nakamura et al. | 418/55.4 |
| 4,861,244 | 8/1989 | Kolb et al. | 418/15 |
| 4,869,658 | 9/1989 | Tsutsumi et al. | 418/55.4 |

*Primary Examiner*—John J. Vrablik
*Attorney, Agent, or Firm*—Bacon & Thomas

[57] ABSTRACT

A tip seal supporting structure for use in a scroll fluid device includes intermeshing involute scroll elements mounted for relative orbital movement. Each of the scroll elements includes an involute spiral wrap which is secured to a respective wrap support plate at one axial end thereof. Each involute spiral wrap is provided with a tip seal in the other axial end thereof which engages with the wrap support plate of the other scroll element. One of the wrap support plates includes a substantially, centrally located fluid passage into which the innermost end of the involute spiral wrap of the other scroll element extends during a predetermined portion of the relative orbital movement between the scroll elements. In one embodiment of the invention, a tip seal supporting structure in the form of a bridge extends across a predetermined portion of this central fluid passage and functions to axially support the innermost portion of the tip seal that extends into this fluid passage during relative orbital movement of the scroll wraps to thereby prevent destructive vibrational effects, to permit the tip seals to extend into the center of the involute scrolls as much as possible, and to maximize the efficiency of the scroll fluid device. In other embodiments, the tip seal is attached to the involute spiral wrap by a fastener. In an additional embodiment, the end of the tip seal is supported by a shelf member formed integral with the involute spiral wrap.

6 Claims, 3 Drawing Sheets

FIG. 2
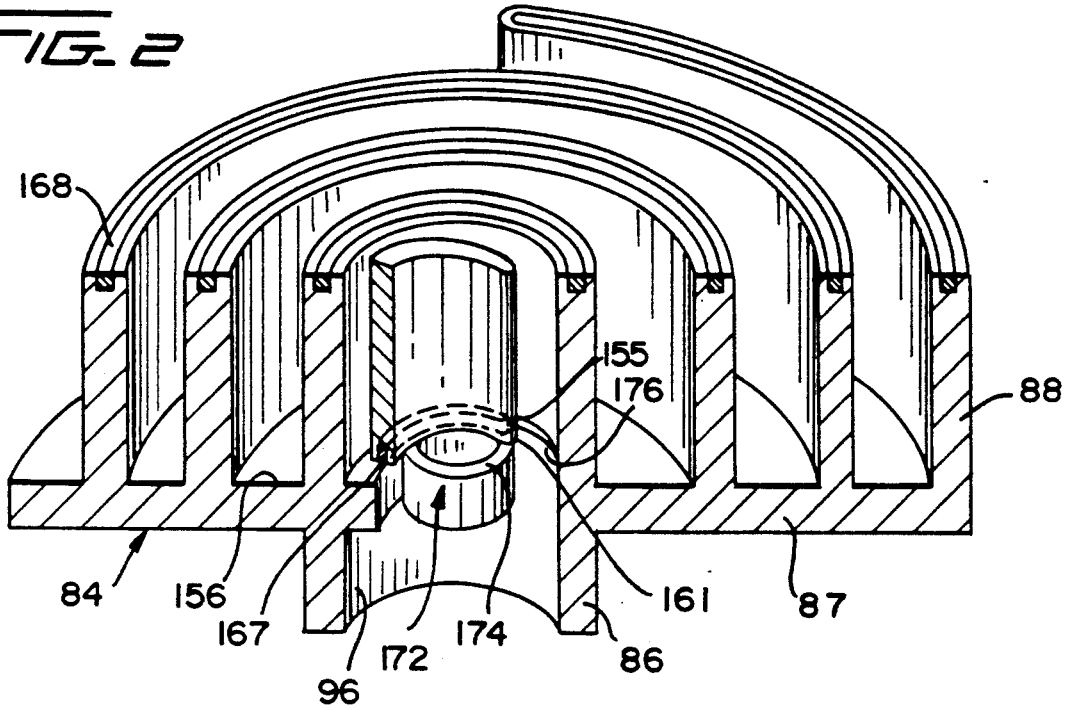
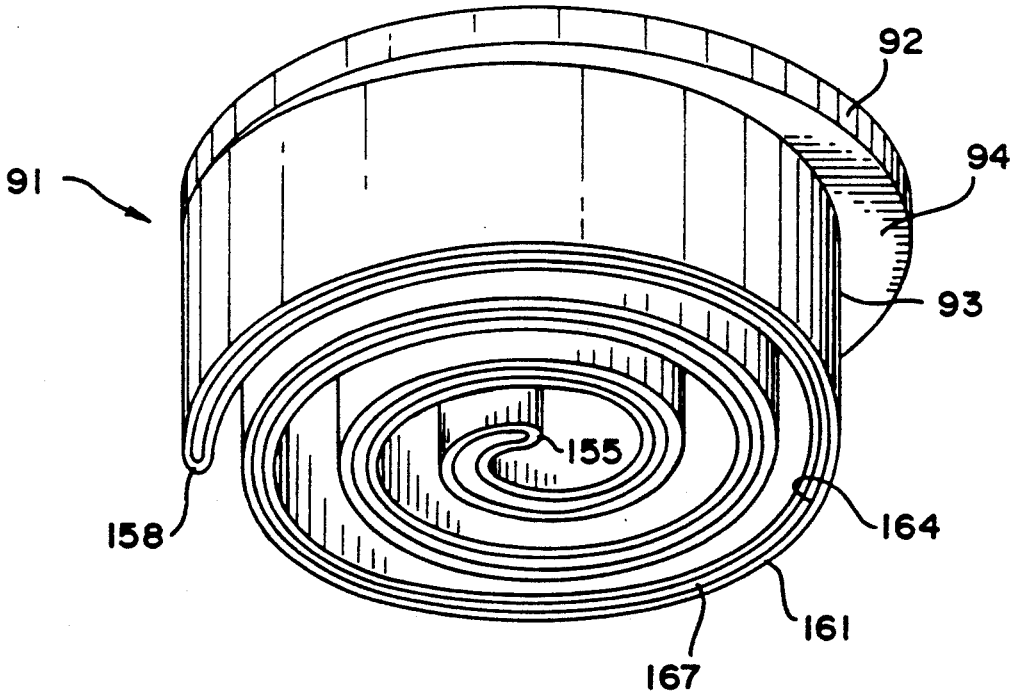
FIG. 3

TIP SEAL SUPPORTING STRUCTURE FOR A SCROLL FLUID DEVICE

BACKGROUND OF THE INVENTION

The present invention pertains to a tip seal supporting structure for use in a scroll fluid device. The tip seal supporting structure includes a bridge which extends across a portion of a fluid flow port located at an orbit center of one of the involute scroll members of the scroll device and functions to support an end portion of a tip seal carried by the other scroll device during a predetermined portion of the relative orbital motion of the scroll members.

In scroll fluid devices having a pair of meshed axially extending involute spiral wraps defining at least one fluid chamber between them that moves radially between an inlet zone and an outlet zone when one wrap is orbited along a circular path about an orbit center relative to the other wrap, tip seals are widely used in the art to axially seal this fluid chamber. These tip seals are arranged to engage wrap support plates to which the involute spiral wraps are respectively fixedly secured. Whether the scroll fluid device functions as a compressor or an expander, one fluid port typically will be substantially centrally located at the center of one of the involute spiral wraps and extend through the respective support plate. If the tip seals extend substantially the entire length of the involute spiral wraps, as is highly desirable in order to maintain proper sealing of the fluid chamber, the tip seal portion at the inner end of the spiral wrap that does not have the fluid port associated therewith will extend beyond the edge of the fluid passage and will therefore be cantilevered for a predetermined portion of the relative orbital movement of the scrolls. Under these circumstances, the tip seal can vibrate which results in wear and/or destruction of the tip seal.

In order to alleviate this problem, some prior art scroll devices, such as that represented by U.S. Pat. No. 4,824,343, utilize tip seals which do not extend to the innermost end of the involute spiral wrap and therefore will not extend into the centrally located fluid port. Although in these prior known arrangements the tip seal will not be cantilevered during a predetermined portion of the relative orbital movement between the involute spiral wraps, during that portion of the relative orbital movement in which the innermost end of the spiral wrap does not extend into the fluid passage, there is no tip seal to provide for axial sealing at the innermost end of the involute wrap. This can result in some leakage of the fluid, a pressure loss and a decrease in the efficiency of the scroll device.

Therefore, to maximize efficiency, there exists a need in the art for a scroll fluid device which enables the use of tip seals which extend to the innermost end of the involute spiral wraps of the scrolls as much as possible and wherein the tip seal can be axially supported during that portion of the relative orbital movement between the scroll fluid wraps when the innermost end of one of the involute wraps extends beyond the edge of the fluid port.

SUMMARY OF THE INVENTION

The present invention provides a tip seal supporting structure for use in a scroll fluid device which solves the problems associated with known prior art devices. The tip seal supporting structure of the present invention is incorporated in a scroll fluid device having first and second meshed axially extending involute spiral wraps having involute centers and defining at least one chamber therebetween that moves radially between an inlet zone and an outlet zone when one wrap is orbited along a circular path about an orbit center relative to the other wrap. At least one of the first and second meshed axially extending involute spiral wraps includes a tip seal secured within a recess formed in one axial end of the involute spiral wrap. This tip seal engages a respective wrap support plate to which the involute spiral wrap is secured so as to axially seal the moving fluid chamber. The present invention incorporates a tip seal supporting structure constituted in one embodiment by a bridge that extends across a centrally located fluid passage that extends through one of the wrap support plates of the scroll fluid device. The bridge functions to axially support the innermost end of the tip seal on the involute spiral wrap that extends into this fluid passage during the relative orbital movement of the first and second involute spiral wraps. In a second embodiment, the supporting structure comprise a screw which extends axially through an involute spiral wrap and attaches the tip seal thereto. In a third embodiment, a pin and slot arrangement is used to support the end of the tip seal. In a fourth embodiment, the involute spiral wrap is integrally formed with a shelf member which axially supports the end of the tip seal.

Since the tip seal supporting structure of the present invention provides axial support for the innermost end of the tip seal projecting into the central fluid passage, the first and second involute spiral wraps may be provided with tip seals which extend into the center of the involute wraps as much as possible to thereby maximize the axial sealing between the spiral wraps and, due to the additional axial support provided, destructive vibrational effects on the tip seal can be prevented.

A fuller understanding of the nature and objects of the present invention will become apparent from the following detailed description of the preferred embodiments thereof when taken in conjunction with the drawings which depict a scroll fluid device incorporating the tip seal support structure of the present invention in a scroll fluid device that functions as a compressor.

BRIEF DESCRIPTION OF THE DRAWINGS

FIG. 2 is a cross-sectional view showing intermeshed portions of the involute spiral wraps and the tip supporting structure of the present invention;

FIG. 3 is a mirror-image view of the upper scroll member used in the scroll-type compressor;

DETAILED DESCRIPTION OF A PREFERRED EMBODIMENT

Although the present invention may be applied to various types of scroll fluid devices, it is depicted and described for exemplary purposes embodied in a hermetically sealed scroll refrigerant compressor which is adapted to be used in a closed-loop expander-condenser refrigeration system.

Figure 1:
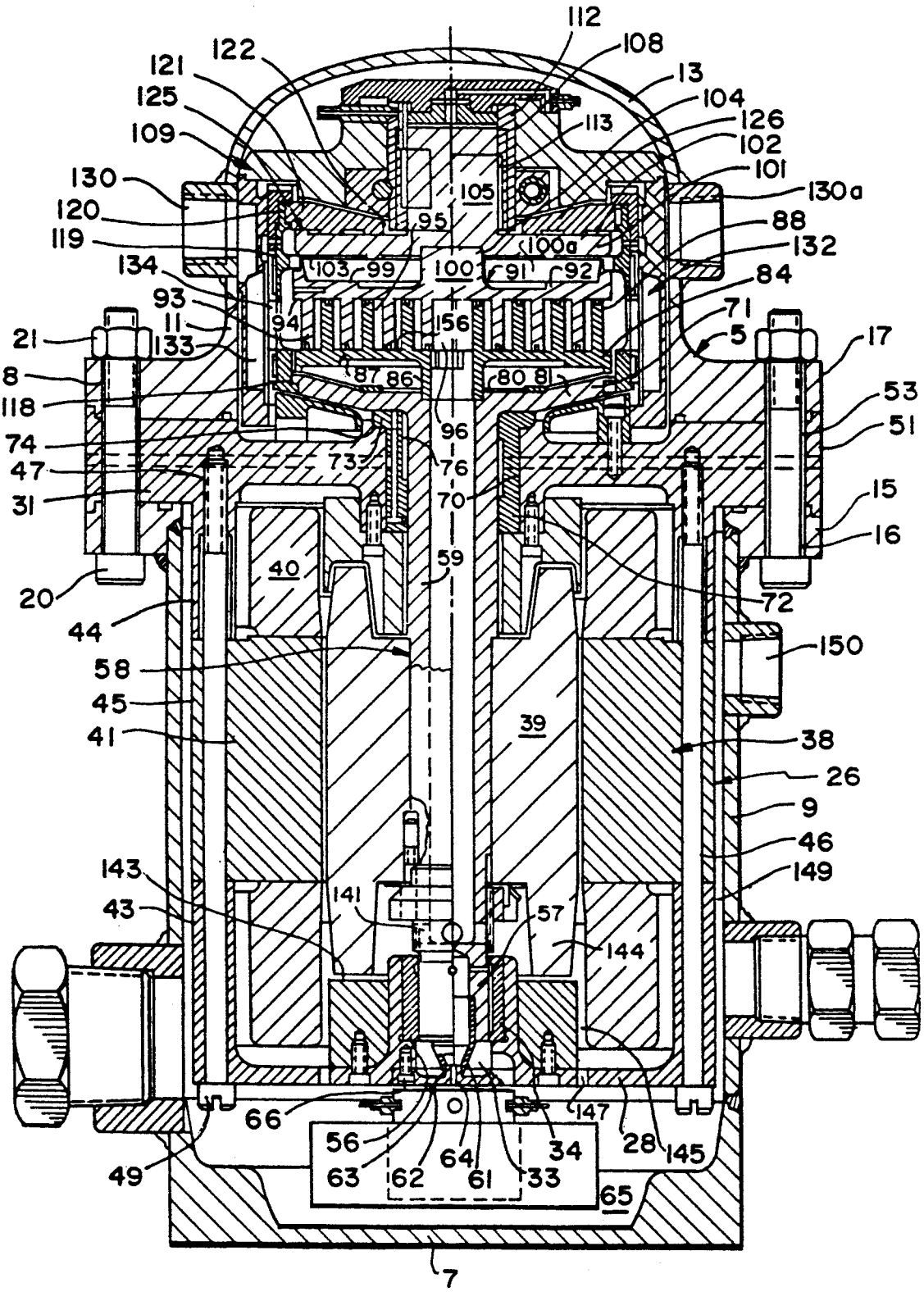
FIG. 1 is a cross-sectional elevational view of a scroll-type compressor incorporating the present invention.

With initial reference to FIG. 1, a compressor is shown comprising a housing assembly 5 including a base plate 7, a lower housing section 9, an upper housing section 11 and a cover member 13. The upper end of lower housing section 9 includes a radially transversely extending annular flange 15 that is either integrally formed therewith or fixedly secured thereto by any means known in the art, such as by welding. Annular flange 15 has various circumferentially spaced apertures 16 extending substantially longitudinally therethrough. The lower end of upper housing section 11 also includes an annular flange 17 including various apertures 18 which are longitudinally aligned with apertures 16 for receiving fasteners such as bolts 20 and nuts 21 for fixedly securing upper housing section 11 to lower housing section 9 as will be more fully described herein.

Located within lower housing section 9 is a motor assembly 26. Motor assembly 26 comprises a bottom plate 28 and an upper crosspiece 31. Located in bottom plate 28 is a lower central aperture 33 defined by an upstanding annular bearing flange 34. Mounted within motor assembly 26 is an electric motor 38 including a rotor 39 rotatable about a longitudinal central axis, windings 40 and a lamination section 41. The exact mounting of motor 38 will be more fully discussed hereinafter.

As depicted, motor assembly 26 includes a lower skirt section 43 integrally formed with bottom plate 28, an upper skirt section 44 formed integral with crosspiece 31 and a central skirt section 45 which is part of lamination section 41. Lower, upper and central skirt sections 43, 44, 45 include an aligned, elongated vertical apertures 46 extending therethrough at circumferentially spaced locations. Aligned with apertures 46, in upper crosspiece 31, is an internally threaded bore 47. Motor housing 26 is secured together by various bolts 49 which extend through apertures 46 and are internally threaded into bore 47 of upper crosspiece 31.

Upper crosspiece 31 includes an annular flange 51 which mates with annular flange 15 of lower housing section 9 and annular flange 17 of upper housing section 11. Annular flange 51 further includes a plurality of circumferentially spaced apertures 53 which can be aligned with apertures 16 and 18 formed in lower housing section 9 and upper housing section 11 respectively. Bolts 20 are then adapted to extend through aligned apertures 16, 53 and 18 and nuts 21 are secured to the bolts 20 in order to fixedly secure upper housing section 11 to lower housing section 9 with upper crosspiece 31 of motor assembly 26 therebetween. By this construction, motor assembly 26 is thereby secured within lower housing section 9.

Press-fit or otherwise secured within upstanding annular bearing flange 34 of bottom plate 28 is a lower bearing sleeve 56. Rotatably mounted within lower bearing sleeve 56 is a lower end 57 of a longitudinal extending hollow drive shaft 58. Drive shaft 58 includes an upper hollow section 59 separated by a partition, as will be explained more fully below, from lower end 57. Located within lower hollow end 57 is an oil cup 61 which tapers inwardly in a downward direction. Oil cup 61 rotates freely around an upstanding central knob 62 formed in an attachment plate 63. Knob 62 includes a centrally located through-hole 64 communicating between the interior of oil cup 61 and a lower sump 65 in order to permit lubricating fluid to flow into and out of oil cup 61. Attachment plate 63 is secured to bottom plate 28 by means of various bolts 66.

Upper portion 59 of drive shaft 58 extends through a central opening 70 in crosspiece 31 and terminates in an integrally formed drive plate 71. Central opening 70 houses an upper bearing sleeve 72 which includes an upper transverse flange 73 embedded in a recess 74 formed in an upper surface of crosspiece 31. Upper bearing sleeve 72 includes a clearance passage 76 for the draining of lubricating fluid bearing medium. Drive plate 71 is dish-shaped and includes a substantially horizontal, central portion 80 and an upwardly sloping outer portion 81.

Located above dish-shaped drive plate 71 is a drive scroll 84 that includes a central, hollow sleeve portion 86, a wrap support plate 87 and an involute spiral wrap 88. Central, hollow sleeve portion 86 is fixedly secure to drive shaft 58 through drive plate 71. Intermeshingly engaged with drive scroll 84 is a driven scroll 91 having a wrap support plate 92 with an involute spiral wrap 93 extending downwardly from a lower first side 94. As is known in the art, defined between involute spiral wrap 88 and involute spiral wrap 93 are fluid chambers 95 that, in this example, transport and compress gaseous refrigerant radially inwardly between the scroll flanks when the scroll is operated. Typically, the scroll fluid device would operate at a high speed within a gaseous fluid medium surrounding the rotating scroll wraps so that, when the device is operated as a compressor, fluid intake occurs at the outer end of each scroll wrap and output flow through the device occurs at central output port 96. Of course, it should be understood that such scroll fluid devices can be operated as an expander by admitting pressurized fluid at port 96 and causing it to expand within the radially outwardly moving fluid chambers 95, to be discharged at the outer ends of the scroll wraps. However, in this description, it will be assumed that the scroll fluid device illustrated is arranged to function as a compressor.

The upper, second side 99 of wrap support plate 92 is formed with an integral central projection 100. Disposed vertically above driven scroll 91 is a pressure plate 101 having an upper side surface 102 and a lower side surface 103. Formed in lower side surface 103 is a central recess 104 into which central projection 100 of driven scroll 91 extends and is fixedly secured therein. Relatively thin reinforcing ribs 100*a* extend from surface 99 of driven scroll 91 to pressure plate 101. On upper side surface 102, opposite recess 104, pressure plate 101 is formed with an axially projecting bearing support shaft 105. Bearing support shaft 105 extends into a central bore hole 108 formed in a fixed support plate 109 in upper housing section 11.

In this embodiment, drive scroll 84 and driven scroll 91 co-rotate and therefore a bearing sleeve 112 is mounted within bore 108 and extends about the periphery of bearing shaft 105. In addition, bearing sleeve 112 includes a clearance passage 113, analogous to clearance passage 76 previously discussed, for the draining of a lubricating fluid medium between bearing shaft 105 and bearing sleeve 112. It is possible, however, to fixedly secure driven scroll 91 and orbit drive scroll 84 about an orbit radius relative to scroll 91.

Extending upwardly from and connected to outer perimeter 118 of drive plate 71 is an annular torque transmitting member 119. Secured to an upper, interior side wall 120 of torque transmitting member 119 is an annular bearing plate 121 having a central through-hole 122 therein through which bearing shaft 105 extends. An Oldham Coupling or synchronizer assembly, generally indicated at 125, is located between annular bearing plate 121 and upper side surface 102 of pressure plate 101 to maintain the drive and driven scrolls 84, 91 in fixed relationship in a rotational sense (i.e., so they cannot rotate relative to each other but maintain a fixed angular phase relationship relative to each other). Annular bearing plate 121 includes at least one clearance passage 126 for the introduction of high pressure oil to counteract the axial gas force developed and to lubricant to the Oldham Coupling.

In order to drive the compressor, electric motor 38 operates in a conventional manner. Lamination section 41 is fixedly secured to upper and lower skirt sections 43, 44 of housing assembly 5. Rotor 39, on the other hand, is secured to drive shaft 58 such that when motor 38 is activated, rotation of rotor 39 causes rotation of drive shaft 58, drive plate 71, drive scroll 84, annular torque transmitting member 119, annular bearing plate 121 and, in the preferred embodiment, driven scroll 91 through the Oldham synchronizer assembly 125 acting through pressure plate 101.

Formed as part of housing assembly 5, between upper housing section 11 and cover member 13, is a housing fluid inlet port 130 which opens up into an annular inlet manifold 132. Inlet manifold 132 includes an inlet passage 133 leading to a scroll inlet port 134 formed in annular torque transmitting member 119, adjacent the involute spiral wraps 88 and 93. The scroll fluid intake zone is provided inside the torque transmitting member 119 around the periphery of the scrolls. Another port 130*a* may be provided optionally for instrumentation access.

When functioning as a compressor, gaseous refrigerant will enter the scroll fluid chambers 95 between spiral wraps 88, 93 through housing inlet port 130, inlet passage 133 and scroll inlet port 134. Upon activation of motor 38 and rotation of drive shaft 58, drive plate 71 and drive scroll 84, gaseous refrigerant will be pumped and compressed through the scroll device and will exit from scroll outlet port 96. Since scroll outlet port 96 opens into the hollow, upper section 59 of drive shaft 58, the compressed refrigerant will run downwardly through upper section 59. Just above lower end 57, drive shaft 58 includes a partitioning drive shaft outlet 141 which opens into motor assembly 26. Thus, refrigerant will be conducted through a passage 143 adjacent lower end 144 of rotor 39, through passage 145 adjacent windings 40 and into lower sump 65 through various outlet holes 147 formed in bottom plate 28. The refrigerant then moves along bottom plate 28, through a clearance passage 149 formed between lower housing section 9 and motor housing 26, and out through a housing outlet port 150.

With reference to FIG. 3 which shows a mirror-image of driven scroll 91, involute spiral wrap 93 includes an inner end 155 and an outer end 158. As previously discussed, one axial end (not labeled) of involute spiral wrap 93 is fixedly secured to lower first side 94 of wrap support plate 92. The other or lower axial end 161 of involute spiral wrap 93 is formed with an involute recess 164 which extends substantially from inner end 155 of involute spiral wrap 93 to outer end 158. Mounted within involute recess 164 is a tip seal 167 which extends axially beyond axial end 161 as indicated in FIG. 2. As known in the art, drive scroll 84 is similarly constructed with a tip seal 168 as shown in FIG. 2. During operation of the scroll fluid device, the respective tip seals 167, 168 engage with the respective wrap support plates 87, 92 so as to axially seal fluid chambers 95. At this point it should be recognized that the present invention could also be used with a scroll fluid device having only a single tip seal as well.

As previously stated, when the scroll fluid device of the present invention functions as a compressor, output flow from fluid chambers 95 between spiral wraps 88, 93 flows out of scroll outlet port 96 and through hollow drive shaft 58. During relative orbital movement between involute spiral wraps 88 and 93, inner end 155 of involute spiral wrap 93 will come out of contact with upper surface 156 of wrap support plate 87 associated with drive scroll 84 and will extend into scroll outlet port 96. Without the tip seal supporting structure of the present invention, when inner end of involute spiral wrap 93 comes out of engagement with upper surface 156 of wrap support plate 87, tip seal 167 would no longer be supported at its end in an axial direction but would rather be cantilevered off upper surface 156.

Figure 4:
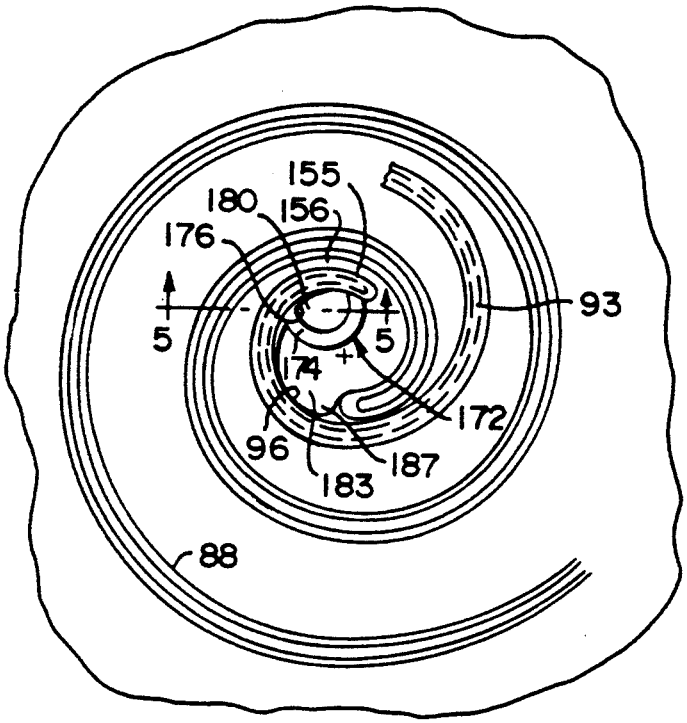
FIG. 4 is a plan view of the discharge port area of a scroll and the tip seal supporting structure according to a first embodiment of the present invention.
Figure 5:
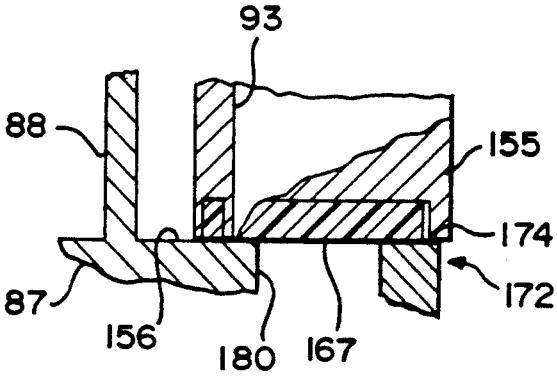
FIG. 5 is a detailed sectional view taken along line 5—5 in FIG. 4.

The present invention contemplates providing a tip seal supporting structure in the form of a bridge 172 which extends across a portion of outlet port 96 as best shown in FIGS. 4 and 5. Bridge 172 is curvilinear as viewed in FIG. 4 and includes a top surface 174 which is located in the same plane as upper surface 156 of wrap support plate 87. Bridge 172 fixedly attached at both ends thereof to inner wall 176 of wrap support plate 87. As can be readily seen from FIG. 4, the inclusion of bridge 172 separates outlet port 96 into a small outlet passage 180 and a larger outlet passage 183.

When the scroll fluid compressor is in operation, involute spiral wrap 93 will orbit relative to wrap support plate 87 of involute sprial wrap 88. During a portion of this relative orbital movement, tip seal 167 will be axially supported by upper surface 156 of wrap support plate 87. During the remainder of this relative orbital movement, the innermost end of the seal 167 will be over outlet port 96 and out of contact with upper surface 156. However, since bridge 172 extends across outlet port 96 in the orbital path of the innermost end of tip seal 167, tip seal 167 is axially support throughout the entire range of relative orbital movement.

In a preferred embodiment, bridge 172 is integrally formed with wrap support plate 87 of drive scroll 84, however, it is to be understood that bridge 172 could be formed as a separate element and fixedly secured to wrap support plate 87 so that upper surface 156 of wrap support plate 87 is in the same plane with top surface 174 of bridge 172. Furthermore, since bridge 172 inherently minimizes the cross-sectional area of outlet port 96, it is possible to compensate for this reduction by reducing the size of wrap support plate 87 adjacent outlet port 96, such as indicated at 187 in FIG. 4, to increase the size of outlet passage 183. The necessity of this would depend on the desired output and pressure requirements of the compressor which could be readily determined by experimentation.

It should be noted that the bridge structure of the present invention could be used on driven scroll 91, as well, in conjunction with a shallow recess to insure that discharging fluid from the center of the scroll compressor has substantially the same flow passage geometry.

Figure 6:
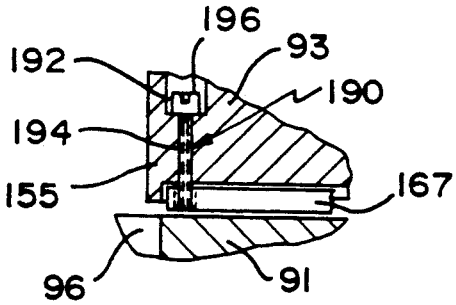
FIG. 6 is a partial cross-sectional view of a scroll and the tip seal supporting structure of a second embodiment of the invention.
Figure 7:
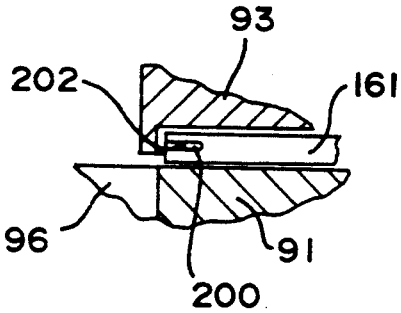
FIG. 7 is a partial cross-sectional view of a scroll and the tip seal supporting structure of a third embodiment of the invention.
Figure 8:
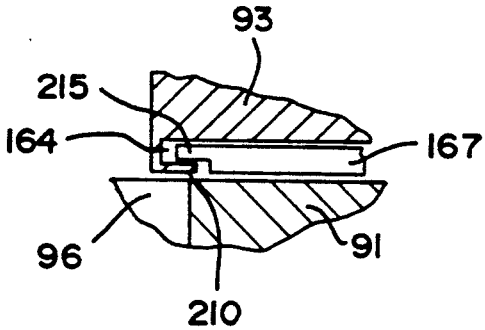
FIG. 8 is a partial cross-sectional view of a scroll and the tip seal supporting structure of a fourth embodiment of the invention.

Reference will now be made to FIGS. 6–8 which depict alternate embodiments of the tip seal supporting structure of the present invention. In each of these embodiments, the tip seal is supported at its end to a respective scroll wrap such that the tip seal will again be supported when located over outlet port 96 as fully discussed below.

In the FIG. 6 embodiment, the inner end 155 of involute spiral wrap 93 of driven scroll 91 includes an axially extending bore 190 having a first diametric portion 192 extending through wrap support plate 92 and a second, reduced diametric portion 194 extending entirely through involute spiral wrap 93. A screw 196 extends through bore 190 and is threadably secured to an inner end of tip seal 167.

In the FIG. 7 embodiment, the inner end of tip seal 167 is formed with a radially extending slot 200 through which a pin 202 extends. Pin 202 is located within a transverse bore (not shown) formed in involute spiral wrap 93. By this construction, tip seal 167 is axially secured to involute spiral wrap 93 but is permitted, due to slot 200, to expand and contract radially a predetermined amount. Of course, involute spiral wrap 93 could, alternatively, be formed with the slot and pin 202 secured within a bore in tip seal 167.

In the FIG. 8 embodiment, inner end 155 of involute spiral wrap 93 is formed with an integral, radially extending shelf member 210 at the inner end of involute recess 164. The inner end of tip seal 167 is formed with a notch such that a reduced thickness portion 215 extends above shelf member 210. Depending upon the axial clearance between shelf member 210 and the notch in tip seal 167, a predetermined amount of radial expansion and contraction of tip seal 167 is also permitted in this embodiment.

Although described with respect to particular embodiments of the invention, it is to be understood that the description was for illustrative purposes only and it is not intended that the invention be limited to the particular configurations described. In general, various changes, and/or modifications can be made without departing from the spirit of the invention as defined by the following claims.

I claim:

1. A scroll fluid device comprising:

first and second meshed axially extending involute spiral wraps having involute centers and defining at least one chamber between them that moves radially between an inlet zone and an outlet zone when the first wrap is orbited along a circular path about an orbit center relative to the second wrap, each of said first and second involute spiral wraps including first and second axial ends;

first and second radially extending wrap support plates to the first axial ends of the wraps and supporting said first and second involute spiral wraps respectively, one of said first and second wrap support plates including a substantially central opening therein defining a port in fluid communication with one of said inlet and outlet zones;

means for mounting said wrap support means for enabling relative orbital motion of said first and second wraps relative to each other about an orbit radius;

at least one tip seal attached to the second axial end of at least one of said first and second wraps, said at least one tip seal including a first end extending closely adjacent to said involute center and projecting over said opening over at least a portion of the orbital motion of its associated wrap; and means for axially supporting the first end of said at least one tip seal at least when said at least one tip seal is located over said opening, said supporting means comprising bridge means extending across a predetermined portion of said opening formed in said one of said first and second wrap support plates and dividing said central opening into a plurality of passages, said bridge means being arranged to axially support the first end of said at least one tip seal attached to the wrap secured to the other of said first and second wrap support plates during at least a portion of the relative orbital motion of said first and second wraps.

2. A scroll fluid device as claimed in claim 1, wherein said bridge means comprises an arcuate surface which divides said central opening into said plurality of passages.

3. A scroll fluid device as claimed in claim 2, wherein said bridge means extends into said central opening by a distance corresponding substantially with the distance said first end of said at least one tip seal attached to the wrap secured to the other of said first and second wrap support plates extends into said central opening during orbital motion of the last said wrap.

4. A scroll fluid device as claimed in claim 1, wherein said scroll fluid device is a compressor and said opening is said outlet zone, and said outlet zone is an outlet for fluid compressed by the scroll fluid device.

5. A scroll fluid device as claimed in claim 4, wherein said scroll wraps are mounted for co-rotation with each other.

6. A scroll fluid device comprising:

a housing;

a drive shaft rotatably mounted within said housing for rotation about a first longitudinal axis;

a first scroll member including a radially extending plate having first and second sides, said first side of said first scroll member being fixedly secured to said drive shaft for rotation of said first scroll member about said first longitudinal axis, said first scroll member also including an axially extending first involute spiral wrap secured to said second side of said first scroll member;

a second scroll member including a second radially extending plate having secured thereto one axial end of a second involute spiral wrap, said second wrap including an inner involute end and an outer involute end, said second wrap extending axially in a direction opposite to said wrap of said first scroll member such that said first and second wraps are meshingly interconnected and define fluid transport chambers therebetween which have progressively and cyclically varying volumes resulting from orbital motion of the wraps relative to each other;

means interconnecting said first and second scroll members for co-rotation such that said second scroll member rotates about a second longitudinal axis which is parallel but offset from said first longitudinal axis;

one of said radially extending plates of said first and second scroll members including a substantially, centrally located fluid port for the passage of fluid therethrough;

a tip seal, having an inner end, carried by the other axial end of said second involute wrap, said tip seal extending substantially the entire length of said second wrap adjacent said inner involute end to adjacent said outer involute end;

means for axially supporting the inner end of said tip seal at least when the inner end is located above said fluid port, said supporting means comprising bridge means extending across a predetermined portion of said fluid port and dividing said fluid port into a plurality of passages, said bridge means being arranged to axially support said tip seal carried by said second wrap during at least a portion of the relative orbital motion of the first and second wraps.

* * * * *